US005238108A

United States Patent [19]

Velezis et al.

[11] Patent Number: 5,238,108

[45] Date of Patent: Aug. 24, 1993

[54] DART CASE

[75] Inventors: George A. Velezis; Anthony F. Velezis, both of Middlebury, Conn.

[73] Assignee: Gavco International, Inc., Woodbury, Conn.

[21] Appl. No.: 934,276

[22] Filed: Aug. 25, 1992

[51] Int. Cl.[5] ..... B65D 85/20

[52] U.S. Cl. ..... 206/315.1; 206/526

[58] Field of Search ..... 273/416; 7/170; 206/315.1, 526, 443

[56] References Cited

U.S. PATENT DOCUMENTS

| | | | |
|---|---|---|---|
| 3,960,271 | 6/1976 | Nelson . | |
| 4,069,528 | 1/1978 | Newton et al. | 7/170 |
| 4,773,578 | 9/1988 | Braun | 224/252 |
| 5,067,610 | 11/1991 | Jensen . | |

FOREIGN PATENT DOCUMENTS

| | | | |
|---|---|---|---|
| 7900893 | 11/1979 | PCT Int'l Appl. | 206/315.1 |
| 650068 | 2/1951 | United Kingdom . | |
| 1342597 | 1/1974 | United Kingdom | 206/315.1 |
| 1429798 | 3/1976 | United Kingdom | 206/315.1 |
| 2225569A | 6/1990 | United Kingdom . | |

*Primary Examiner*—Bryon P. Gehman

*Attorney, Agent, or Firm*—William C. Crutcher

[57] ABSTRACT

A dart case comprising a base member, a hinged cover member, and a latch. Both of the base and cover have recesses formed in their facing inner surfaces. Some of the recesses are used to hold dart accessories and a sharpening stone. Selected pairs of base and cover recesses are sized and located to be substantially coterminous so as to define flight compartments. Each flight compartment includes flight support members projecting toward one another from the cover and the base which support and protect the dart flights. The flight support members include inclined orthogonal surfaces so that the cover member may be pivoted and closed upon the base member without damaging the flights. Further features include a rotatable sector attached to the cover in order to hold accessories in the cover member when the cover is open. Lastly, the exterior of the case cover includes dart support pockets holding the darts accessible for display and use.

8 Claims, 2 Drawing Sheets

DART CASE

BACKGROUND OF THE INVENTION

This invention relates generally to a case for carrying darts and dart accessories. More particularly, it relates to improvements in a dart case designed to protect the flights of the dart, to carry the many accessories useful to players of dart games, and to hold the darts for display or when they are in use.

Numerous types of carrying cases for darts and dart accessories are known in the art. Darts generally are not made up of a point, a body which may further comprise a barrel and a shaft, and flights or feathers to guide the dart in flight. Although the dart may be a unitary assembly, darts of higher quality are made up of separable components including the points, barrels, shafts and flights. Other accessories and tools are also needed, so that if a dart becomes damaged, it can be repaired. Accordingly it would be desirable to have a dart case which holds not only darts, but also the numerous accessories, tools and implements which might be needed.

The flight is the most fragile part of the dart. Since the flight projects from the dart body and is generally comprised of feathers or thin flat plastic fins, many prior art dart cases have addressed the problem of protecting the flights. The flights or feathers generally are mutually perpendicular, projecting orthogonally from the dart body. The prior art dart cases have generally provided for a longitudinal insertion of the dart, point first, into a pocket, which includes a cruciform opening or series of mutually perpendicular slots to receive the flights when the dart is inserted.

Examples of the prior art include UK Patent Application 6B 2.225.569 A granted to Lee, published Jun. 6, 1990; British Patent Specification 1,429,798-Butterworth filed Jan. 25 1973; British Patent Specification 650,068-Kneale, published Feb. 14, 1951; Nelson U.S. Pat. No. 3,960,271 issued Jun. 1, 1976 and Jensen U.S. Pat. No. 5,067,610 issued Nov. 26, 1991. The latter patent discloses a dart box made up of two halves, which are permanently joined to receive longitudinally inserted darts. The Jensen patent also contains additional compartments for inserting dart accessories at the end of the carrying case and holding them with a cover.

Another problem which has been addressed by the prior art is to hold the darts so as to protect the points and yet leave the darts accessible for use. Various holding accessories have been disclosed, among these British Specification 1,342,579-Newman filed Feb. 17 1970; Braun U.S. Pat. No. 4,773,578 issued Sep. 27, 1988; and Henderson U.S. Pat. No. 4,294,365 issued Oct. 13, 1981. The latter Henderson patent comprises a box-like body with sockets to receive the spikes of the darts and hold them accessible for use.

The present invention offers an improved dart carrying case designed to protect the flights of the dart, to hold the darts accessible for use or display, and to provide the maximum available storage space for darts, and dart accessories such as parts and tools.

Accordingly, one object of the invention is to provide an improved dart case for protecting the flights during storage.

Another object of the invention is to provide an improved dart case for displaying or holding the darts safely in a position ready for use.

Another object of the invention is to provide an improved dart case for holding darts, as well as dart parts, accessories and tools.

SUMMARY OF THE INVENTION

Briefly stated, the invention is practiced by providing a dart case comprising a base member, a cover member, and means for temporarily connecting together the base member and cover member. Both of the base and cover have recesses formed in their facing or miner surfaces. Some of the recesses are used to hold dart accessories. Selected pairs of base and cover recesses are sized and located to be substantially coterminous so as to define flight compartments. In its preferred form, the flight compartment includes flight support members projecting toward one another from the cover and the base which support and protect the dart flights. Also in its preferred form, the cover is hinged to the base and the flight support members include inclined orthogonal surfaces so that the cover member may be pivoted and closed upon the base member without damaging the flights. Further features include retaining means to hold accessories in the cover member when the cover is open. Lastly, the exterior of the case cover includes dart support pockets holding the darts accessible for display and use.

DRAWING

The subject matter, which is regarded as the invention, is particularly pointed out and distinctly claimed in the concluding portion of this specification. The invention, however, both as to organization and method of practice, together with further objects and advantages thereof, may best be understood by reference to the following description, taken in connection with the accompanying drawing, in which:

FIG. 1 is a top plan view of the dart case with the cover shown open and disposed alongside the base, FIG. 2 is an elevational view taken in cross section through the dart compartments at the location of the arrows II—II in FIG. 1, but after the cover is closed and latched to the base, and FIG. 3 is a perspective view of the dart carrying case with the cover closed and latched to the base and holding three darts.

DESCRIPTION OF THE PREFERRED EMBODIMENT

Figure 1:
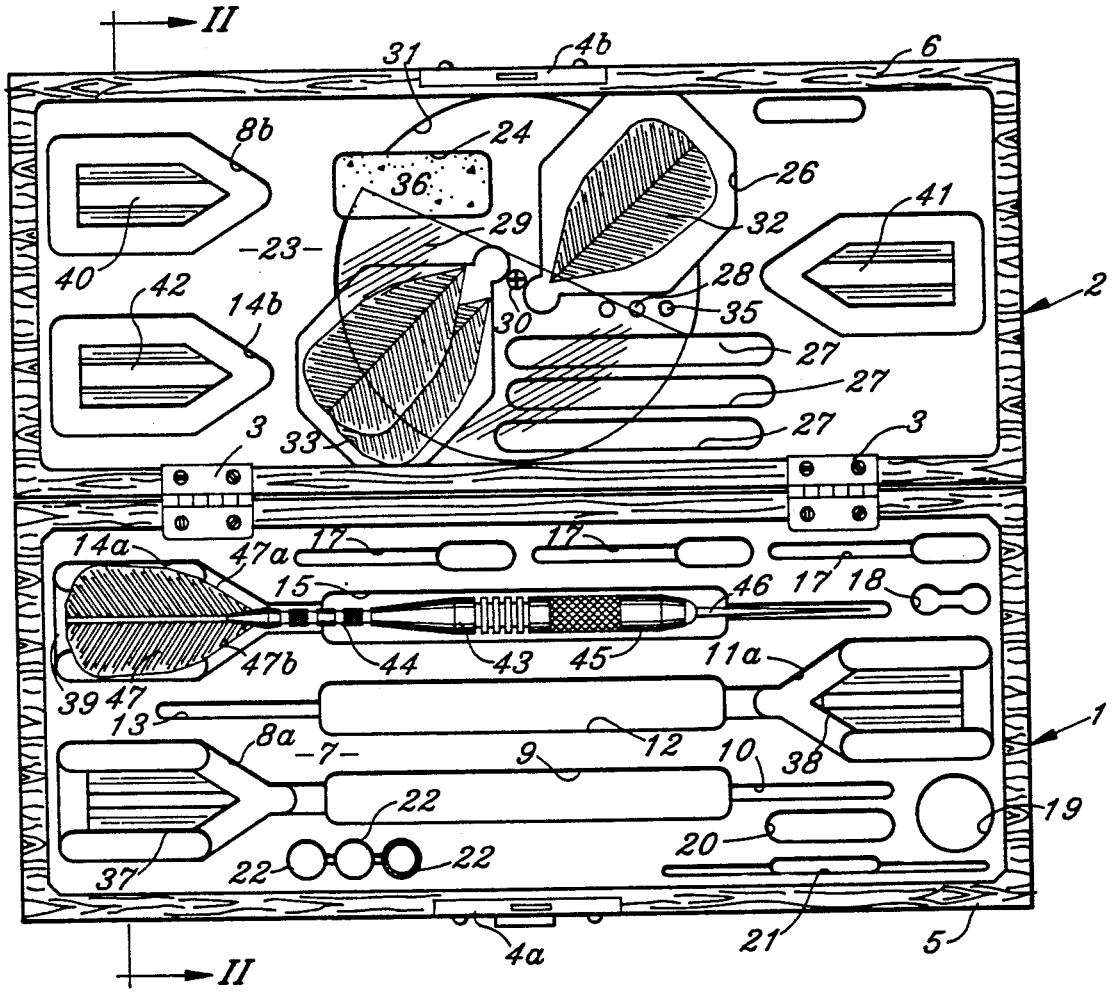
Figure 3:
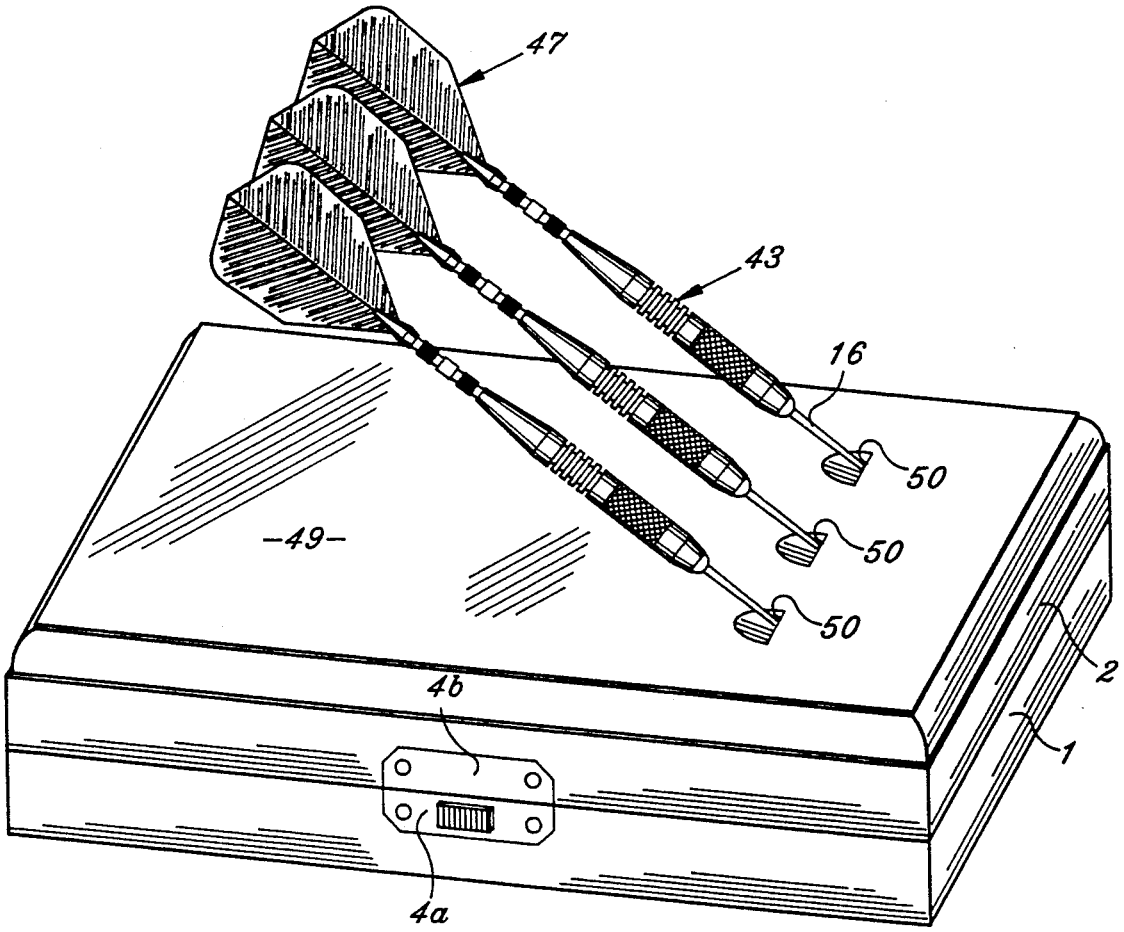

Referring now to FIG. 1 of the drawing, the preferred embodiment of a dart case is shown to comprise a base member 1 and a cover member 2 pivotally connected by a pair of hinges 3. The case is adapted to be latched when cover 2 is pivoted into a closed position on top of base member 1 and connected by means of the two latch halves 4*a*, 4*b*. Reference to FIG. 3 illustrates the dart case in a closed and latched position, whereby the base member 1 is connected to cover member 2.

Base member 1 is generally rectangular as indicated in FIG. 1 having a peripheral recess 5 around the outer edge, which is adapted to cooperate with a similar peripheral ledge 6 on cover member 2 to form a mating rabbet fit. This may also be seen more clearly at FIG. 2, which is a cross section taken generally in the location of II—II, but when the cover is connected to the base as shown in FIG. 3.

The central part of base member 1, comprises an inner surface 7 in which are defined a plurality of base recesses of varying shapes and sizes adapted to hold darts, dart parts, dart accessories and tools. These may be identified as a flight compartment recess 8*a*, a dart body recess 9, a dart point recess 10; an oppositely directed flight compartment recess 11*a*, dart body recess 12, dart point recess 13, and an oppositely directed flight compartment recess 14*a*, dart body recess 15 and dart point recess 16. Additional base recesses include three identical dart point recesses 17, a recess 18 for washers and stem rings, recesses 19, 20 and 21 for special dart wrenches and three connected recesses 22 for weights.

Similarly, the cover member 2 includes an inner surface 23 in which are defined a plurality of cover recesses, which may be identified as follows. Flight compartment recess 8*b*, oppositely directed flight compartment recess 11*b* and oppositely directed flight compartment recess 14*b* are so sized and located so as to be generally coterminous with the aforementioned flight compartment recesses 8*a*, 11*a* and 14*a* in base member 1. The coterminous pair 8*a*, 8*b* together make up a flight compartment 8 when the cover member is latched to the base member. Similarly the coterminous pair 11*a*, 11*b* make up flight compartment 11, and the coterminous pair 14*a*, 14*b* make up flight compartment 11.

Additional cover recesses include a sharpening stone recess 24, a first spare flight recess 25, a second spare flight recess 26, three identical shaft recesses 27, and three recesses 28 for holding flight deflectors.

Inasmuch as accessories or parts contained in the cover member 2 would tend to fall out when the cover is opened, a movable retaining means is provided comprising a rotatable circular sector 29 mounted on an axis 30 within a circular recess 31. Dart parts, such as flattened out dart spare flights 32, 33 spare dart shafts 34, and flight deflectors 35 are shown by way of example. The rotatable sector 29 is movable to a first position to prevent accessories from falling out from the cover recesses, and movable to a second position to permit removal of a dart part or accessory. A sharpening stone 36 is permanently attached in the recess 24, so that it will not fall out.

In accordance with one aspect of the present invention, each of the flight compartment halves 8*a*, 11*a* and 14*a* in the base member and each of the corresponding flight compartment halves 8*b*, 11*b* and 14*b* in the cover member are fitted with a flight support member centrally disposed in the flight compartment recess. Flight support members in the base member are identified by reference numerals 37, 38, 39 and flight support members in the cover member identified by reference numerals 40, 41, 42. Although ordinarily the dart case would be used to hold a complete set of three darts, only a single dart 43 is shown disposed in base member 1, for illustrative purposes. Dart 43 includes a shaft 44, and barrel 45, together making up a dart body, dart point 46, and dart flight 47.

Figure 2:
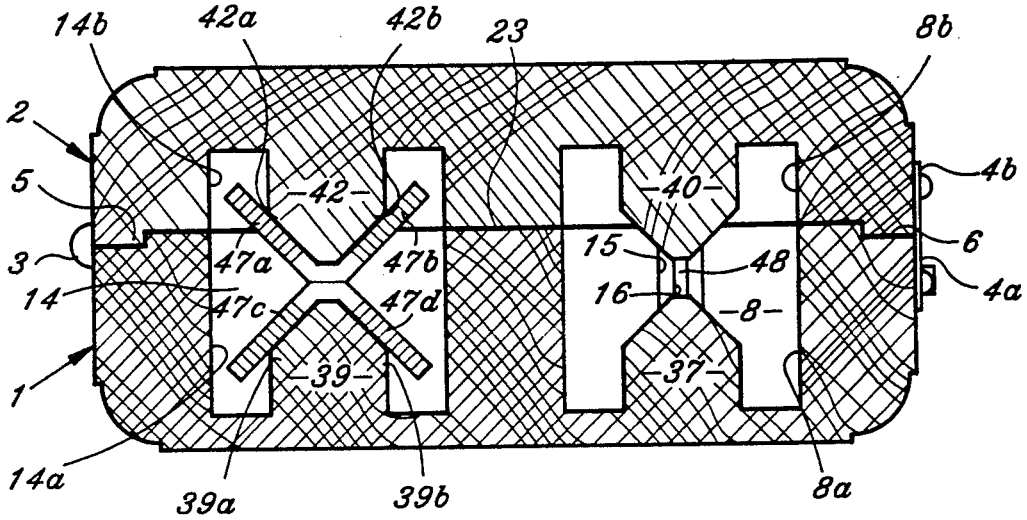

Reference to FIG. 2 illustrates that dart flights 47 comprise orthogonally projecting flight members 47*a*, 47*b* and orthogonally projecting flight members 47*c*, 47*d*. The two flight compartment recesses 14*a*, 14*b*, together make up a single flight compartment 14. The base flight support member 39 includes a pair of inclined orthogonal surfaces 39*a*, 39*b* which support flight members 47*c*, 47*d*. The flight support member 42 in the cover similarly defines two orthogonal inclined surfaces 42*a*, 42*b*. When the cover 2 is closed, the flight support member 42 presses down upon the flight and securely holds it against flight support member 39 and protects it from damage. It will be observed that in its preferred form, the dart body recess 15 and the point recess 16 are contained completely within the base member 1. Thus the dart 43, with the exception of just the upper edges of flights 47*a*, 47*b* is wholly contained within the base member. This has two advantages . . . First, the bodies of the darts do not project into the upper half or cover member, thereby allowing maximum storage space for accessory parts in the cover member. Secondly, the inclined position of the flights allows ample clearance for the upper flight support members such as 42 to enter the space between the flight members as the cover is closed, so as to facilitate closure of the dart case without damaging the flights. Reference to FIG. 2 of the drawing shows that the axis of dart body recess 15 and dart point recess 16 is disposed within the base member and lie below the joined inner surfaces 7, 23 of the case. This axis is indicated by reference 48.

A further feature of the invention is illustrated by reference to FIG. 3. The cover member 2 includes an outer surface 49 in which are defined three inclined dart support pockets which are oriented to receive the points 16 of darts 43 on an angle. Therefore when the cover 2 is closed and latched, a set of three darts will be displayed in an attractive fashion and oriented for ease of use, as well as protecting the points and protecting those nearby from injury.

Other modifications will occur to those skilled in the art. For example, although the preferred embodiment has the cover member pivotally connected to the base member by a hinge on one side with a latch on the opposite side, it is within the scope of the invention to include latch halves such as 4*a*, 4*b* on both sides of the case, so that cover 2 may be unlatched on both sides removed, and inverted to appear as shown in FIG. 1 without necessarily being premanently connected to the base member. In place of latch halves 4*a*, 4*b*, a detented or snap fit connection could be used between cover member 2 and base member 1. Other means for temporary connection between the members are known in the art, so that the benefits of the disclosed invention may be achieved.

While the retaining means in the cover member is shown as a rotatable sector, a sliding retaining means could also be employed to retain the parts and accessories in cover member 2, but still make them available for removal when needed.

While there has been shown what is considered to be the preferred embodiment of the invention, we desire to secure in the appended claims all such modifications as fall within the true spirit and scope of the invention.

We claim:

1. A dart case for carrying darts and dart accessories, said dart case comprising:

a base member having an inner surface defining a plurality of base recesses therein, a cover member having an inner surface defining a plurality of cover recesses therein, means for temporarily connecting together said base member and said cover member so that said inner surfaces face one another, selected recesses being adapted to receive a plurality of darts, each of said darts having a body with flights projecting therefrom, selected pairs of base and cover recesses being so sized and located as to be substantially coterminous when said base member and said cover member are connected together each of said selected pairs of recesses being adapted to together define a flight compartment for receiving said projecting flights of said plurality of darts, and said base member and said cover member further respectively defining a base flight support member and a cover flight support member which respectively project from base and cover recesses of each of said selected coterminous pairs of recesses, said support members adapted to support said projecting flights within said flight compartments.

2. The dart case according to claim 1, wherein each of said flight support members defines an orthogonal pair of inclined surfaces adapted to support orthogonally projecting dart flights, and whereby placement of said cover member on said base member is facilitated by flights disposed in an inclined orientation so as to easily receive a cover flight support member.

3. The dart case according to claim 1, wherein the base recess of each of said selected coterminous pairs is connected to an adjacent base recess adapted to receive a complete dart body and a dart point, so that a substantial portion of a complete dart is contained within said base member.

4. The dart case according to claim 1 wherein said connecting means comprises at least one hinge for pivotably joining said base member to said cover member and a latch for fastening said members so as to hold said inner surfaces together.

5. The dart case according to claim 1, wherein said cover member has an outer surface, said outer surface defining a plurality of dart support pockets adapted to receive the points of said darts so as to support the darts in an accessible location for use.

6. The dart case according to claim 5, wherein said dart support pockets are inclined so as to support the darts in an inclined position.

7. The dart case according to claim 1, wherein selected cover recesses in said cover member are adapted to hold dart accessories and further including movable retaining means adapted to prevent accessories from falling from the cover recesses in a first position and movable to a second position to permit removal of a dart accessory from a cover recess.

8. The dart case according to claim 1, wherein said dart case includes a sharpening stone disposed in one of said recesses, whereby dart points may be sharpened.

* * * * *